US006544710B2

(12) United States Patent
Livengood et al.

(10) Patent No.: US 6,544,710 B2
(45) Date of Patent: Apr. 8, 2003

(54) REACTIVE COMPATIBILIZATION OF POLYMERIC COMPONENTS SUCH AS SILOXANE POLYMERS WITH TONER RESINS

(75) Inventors: Bryan Patrick Livengood, Longmont, CO (US); Brian William Baird, Louisville, CO (US); George Pharris Marshall, Boulder, CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/897,866

(22) Filed: Jul. 2, 2001

(65) Prior Publication Data

US 2002/0018951 A1 Feb. 14, 2002

Related U.S. Application Data

(62) Division of application No. 09/219,950, filed on Dec. 23, 1998, now Pat. No. 6,350,552.

(51) Int. Cl.[7] ..... G03G 9/087; G03G 9/097

(52) U.S. Cl. ..... 430/137.1; 430/108.1; 430/108.22; 430/108.24; 430/108.3; 430/109.3; 430/137.18

(58) Field of Search ..... 430/108.24, 109.3, 430/109.1, 108.1, 108.3, 109.5, 137.1, 137.18, 108.9, 108.5, 108.4, 109.2, 109.31, 137.2, 108.8, 108.22

(56) References Cited

U.S. PATENT DOCUMENTS

| | | | | |
|---|---|---|---|---|
| 4,876,169 A | | 10/1989 | Gruber et al. | 430/110 |
| 4,883,735 A | | 11/1989 | Watanabe et al. | 430/109 |
| 5,059,505 A | | 10/1991 | Kashihara et al. | 430/110 |
| 5,073,469 A | | 12/1991 | Diaz et al. | 430/110 |
| 5,202,215 A | | 4/1993 | Kanakura et al. | 430/137 |
| 5,229,242 A | | 7/1993 | Mahabadi et al. | 430/106.6 |
| 5,310,616 A | | 5/1994 | Akamatsu | 430/110 |
| 5,318,883 A | | 6/1994 | Yamanaka et al. | 430/110 |
| 5,368,970 A | * | 11/1994 | Grushkin | 430/109.4 |
| 5,506,083 A | * | 4/1996 | Nash et al. | 430/109.3 |
| 5,512,406 A | | 4/1996 | Takeda et al. | 430/110 |
| 5,968,689 A | * | 10/1999 | Torikoshi et al. | 430/18 |
| 6,350,552 B1 | * | 2/2002 | Livengood et al. | 430/108.22 |

OTHER PUBLICATIONS

Kolb et al, "In Situ Generation of Polymeric dyes by Thermal Activation," IS & T's 47th Annual Conference/ ICPS, May 1994, Rochester, NY, pp 806–807, 1994.*

J.G. Bonner and P.S. Hope, Polymer Blends & Alloys, "Compatibilisation and Reactive Blending", 1993, pp. 46–73.

George Marshall, "Toner Technology: An Overview and Trends", Society for Imaging Science & Technology NIP 12, San Antonio, TX, Oct. 27, 1996.

* cited by examiner

*Primary Examiner*—Janis L. Dote
(74) *Attorney, Agent, or Firm*—John A. Brady

(57) ABSTRACT

A toner composition comprising a primary resin and at least one additional polymeric component is improved by reactive compatibilization of the additional polymeric component and the resin. For example, effective amounts of a functional secondary resin and a functional silicone oil having functionality reactive therewith are included and mixed by extrusion so as to reduce or eliminate speckling in printing with the toner and the improve toner powder flow.

9 Claims, 1 Drawing Sheet

I.

x = 1-20 y = 1-2,500

+ →

II.

m = 1-500 n = 0-6 o = 1-200

III.

y = 1-2,500

REACTIVE COMPATIBILIZATION OF POLYMERIC COMPONENTS SUCH AS SILOXANE POLYMERS WITH TONER RESINS

CROSS-REFERENCE TO RELATED APPLICATION

This is a division of a application, Ser. No. 09/219,950, U.S. Pat. No. 6,350,552 B1, filed Dec. 23, 1998.

TECHNICAL FIELD

The present invention relates to toners and developers for electrophotography to be used in developing electrical or magnetic latent images in electrophotography, electrostatic printing, and the like.

BACKGROUND OF THE INVENTION

Toner for developing electrical or magnetic latent images and the like are used in various processes for forming and recording images. One of such image forming processes is electrophotography, which uses a photosensitive member generally formed of a photoconductive material, and wherein an electrical latent image is formed on the photosensitive member by various means. The electrical latent image is developed using a toner. The toner image thus developed transferred to a recording material, such as paper, and then fixed there to by heating and/or pressure, or by using solvent vapor or the like, thus obtaining a copy of the image. Where a process for transferring toner images to a recording material is included, there is usually also provided a process for removing the toner remaining on the photosensitive member.

The following are examples of developers conventionally used in dry development devices for electrophotography:

1) One-component-type magnetic developers comprising a toner containing magnetic powder.
2) One-component-type non-magnetic developers comprising a toner containing no magnetic powder.
3) Two-component-type non-magnetic developers comprising a toner containing no magnetic powder and a magnetic carrier, which is mixed with the toner in a fixed proportion.
4) Two-component-type magnetic developers comprising a toner containing magnetic powder and a magnetic carrier, which is mixed with the toner in a fixed proportion.

Various development methods using such toners have been proposed and put into practical use. The toners used in these development methods are generally manufactured by a pulverizing method in which a coloring agent like a dye or pigment is mixed with, and uniformly dispersed in, a thermoplastic resin serving as the binder. The mixed substance thus obtained is then finely pulverized and classified to provide a desired particle size distribution. Toners typically contain a principal resin or toner resin, colorant and various functional additives such as release agents and charge control additives.

Heterogeneity of the toner particles' composition is believed to be the root cause of numerous problems throughout the serviceable life of toner in a printing device. The print quality black-on-white (BOW) defect involving unwanted toner black spots on the printed product has been a recurring and sometimes serious problem in certain commercial printers over the past few years. The black spots are highly visible in the background region of the print and are non-repeating in nature. They can and do occur anywhere in the background region of the print and usually appear later in the cartridge life. The onset of this print quality defect depends upon many factors including the print job length. As the print job length decreases (e.g., from 4 to single page jobs), the severity of the black spots increases, and the number of prints before the onset of the defect decreases (e.g., from 16,000 to 10,000 prints). Furthermore, it appears that the extent of these spots and the location of their onset with respect to the number of pages printed is also a function of the percent coverage of toner on the page. Another factor which has proven to affect the level of this defect is the number of developer roll revolutions since the beginning of the cartridge life. The higher the number of such revolutions, the quicker the onset of the spots and the greater their extent.

Even though the precise mechanism for the formation of such black-on-white defects is unknown, it has been observed that a number of factors associated with the toner affect the extent of these defects and the time it takes for their onset. Various extra-particulate additives (EPAS) have been found to reduce the number of spots and delay their onset to higher print counts. However, increasing the level of such additives does not totally eliminate the spots, but does contaminate the charge roll and other machine parts, thereby shortening their useful life. A concern with EPAs in general is the increased abrasivity of the resulting toner and the resulting increase in wear on the contacting device components. Nevertheless, to date no EPAs have been found to totally and consistently eliminate these BOW defects without causing premature cartridge failure.

While Applicants do not wish to be bound by any theory of the mechanism of BOW defect formation, it is presently believed that the toner particle compositional uniformity is a major factor in the existence of such defects. Heterogeneity of the toner particles' composition is believed to be the root cause of observed selectivity throughout the life of the cartridge. An experiment was conducted to prove that the compositional make-up of the toner left in the developer station after the onset of BOW defects is the primary factor affecting this phenomenon. After the onset of black spots was observed in a printer with a particular electrophotographic cartridge, "fresh" toner was added to the developer station and the spots disappeared for a few thousand pages. However, they did return. Moreover, when "used" end-of-life toner is added to a new cartridge, the defects begin almost immediately. Despite these observations, it has yet to be analytically determined what differences in the toner from beginning of cartridge life to the onset of BOW defects are contributing to the formation of these print quality defects.

The present invention successfully eliminates the lack of heterogeneity in toners with the addition of two functional additives reactive with each other to form a stable reaction product. The copolymer reaction product apparently acts as a compatibilizer to improve the dispersion of various polymeric components (such as a release agent) with the backbone structure of the toner resin.

Most toner compositions employ release agents such as waxes and/or silicone polymers. Poly(dimethysiloxane) resins or oils (PDMS) are well known to exhibit excellent external release agent characteristics (i.e. when applied to fuser rolls) due to their extremely low surface energy. The property is highly desirable in contact-fusing electrophotography because it is important to be able to release the toner from the hot-oiled fuser roll and thus prevent hot offset from occurring. Several different low molecular weight organic materials have been used in the toner industry to try to eliminate this hot offset phenomenon. Low molecular weight polyolefin waxes are by far the most common type of internal release agent. Each type of release agent has its own advantages and disadvantages. For example, polyolefins tend to crystallize to a significant extent (between 70 and 90 volume percent crystallinity). When these molecules crystallize, they phase segregate from the toner resin and form large wax domains which cause numerous print quality defects, as well as a wax imbalance between the toner fines and the average sized toner particles. Poor homogeneity of these additives in the toner particles tends to cause a number of problems, the most important of which are low toner powder flow and variations in triboelectric charge distribution, which can lead to print quality defects.

Methods have been reported for compatibilization of immiscible blends of polymers by reactive mixing, in which functionalized versions of the polymeric components react in situ to form a block copolymer compatibilizer. The fundamental requirements for such reactive processing include the following: There must be sufficient mixing to achieve the desired fineness of morphological texture. Some of the polymer molecules must contain chemical functional groups which can react to form primary bonds during the mixing/mastication process. The functional groups must be of sufficient reactivity for reactions to occur across melt-phase boundaries. The reactions must occur rapidly enough to be completed during processing in the extruder or mixer within a reasonable time. The bonds formed as a result of reactive blending must be stable enough to survive subsequent processing. In short, the compatibilization reactions should be fast and irreversible.

The use of blends and alloys of immiscible polymers has increased because it is generally less expensive to develop a new blend composition than to develop new polymers based upon new monomers to meet needs for specialized types of polymers. Compatibilizing methods and agents are required for such blends, since most polymers are mutually immiscible and have poor interfacial adhesion. Compatibilizers generally are believed to act at interfaces to improve interfacial interactions between immiscible polymeric species. Thermodynamic miscibility or compatibility is discussed briefly by Bonner and Hope, infra. It is recognized that miscibility between polymers is determined by a balance of enthalpic and entropic contributions to the free energy of mixing. While for small molecules the energy is high enough to ensure miscibility, for polymers the entropy is almost zero, causing enthalpy to be decisive in determining miscibility. The change in free energy on mixing (AG) is written as $$\Delta G=\Delta H-T\Delta S$$

where H is enthalpy, S is entropy and T is temperature (K). For spontaneous mixing, ΔG must be negative, and so $$\Delta H-T\Delta S<0.$$

This implies that exothermic mixtures (ΔH<0) will mix spontaneously, whereas for endothermic mixtures miscibility will only occur at high temperatures. However, thermodynamic compatibility need not be attained—technological compatibility, where the blend has useful properties, normally is sufficient. Mechanical or chemical techniques can be used to attain technological compatibility.

Technological compatibility of immiscible polymers can be produced by: the addition of a compatibilizer before or during the mixing/blending process; adjustment of viscosity ratios to favor rapid formation of the desired phase morphology during mixing; in situ formation of a compatibilizer during the mixing/blending process; and introduction of crosslinks in one of the phases. The objectives of technological compatibilization are to produce compositions which exhibit good ultimate properties, e.g. strength, elongation, fatigue life, etc. Compatibilized polymer blends exhibit at least some of the following differences from uncompatibilized polymer blends: Reduced morphological dimensions (smaller domain sizes, thus smaller potential flaws); Improved bonding or adhesion between phases; and reduced tendencies to form highly shaped domains during flow in processing, molding, etc.

One approach to technological compatibilization is the addition of a compatibilizer before or during the mixing/blending process. Such compatibilizers are frequently a block copolymer. To be effective, the compatibilizing block copolymer must possess segments with chemical structures or solubility parameters, which are similar to or the same as those of the polymers being blended, and a sufficient amount of the compatibilizing polymer must be located at the interface of the polymer phases. Such copolymer compatibilizers are disclosed in numerous patents assigned to Xerox Corporation, e.g. U.S. Pat. No. 5,229,242. A method of promoting the presence of a compatibilizing block copolymer at the interfacial region is to use reactive mixing techniques, whereby the compatibilizing copolymer forms at the interface. In such cases, polymer molecules of one phase contain functional groups which chemically interact with molecules of a polymer in an adjacent phase, so that a compatibilizer forms in the interfacial regions where it is needed.

Bonner and Hope provide an extensive discussion of compatibilization of polymer blends in "Compatibilization and reactive blending," Chapter of *Polymer Blends and Alloys*, Edited by M. J. Folkes and P. S. Hope, Blackie A & P, 1993.

U.S. Pat. No. 5,310,616 to Akamatsu discloses toner compositions for electrostatic copiers containing siloxane resins with difunctional and trifunctional siloxane units as charge regulating agents. The siloxane units of the resins can contain aminofunctional hydrocarbon radicals or haloalkyl radicals.

U.S. Pat. No. 4,876,169 to Gruber et al. discloses toner compositions containing particles of polyesters with siloxane block segments, the particles containing release additives.

U.S. Pat. No. 5,202,215 to Kanakura et al. discloses toners which are prepared by dispersion-polymerizing a vinyl monomer in the presence of a dispersion polymerization stabilizer, a polymerization initiator and silicone-containing organic resin microparticles in a dispersion medium which dissolves the vinyl monomer, the polymerization stabilizer and the initiator but not the silicone-containing organic resin microparticles or the resulting toner particles. Amino-silicone compounds can be used in the microparticles.

U.S. Pat. No. 5,059,505 to Kashihara et al. discloses spherical resin particles for electrophotographic toners, prepared by a process involving a dispersion stabilizer which can contain a dialkylaminosiloxane. The toner resin itself can contain monomers such as styrene and maleic acid.

U.S. Pat. No. 5,512,406 to Takeda et al. discloses toner compositions having bimodal particle size distributions, produced by admixing toner portions having different particle size distributions with functional additives, then combining the portions thus prepared.

One advantage of the present invention includes successfully reducing or eliminating the disadvantages that come with using siloxane polymer materials as internal release agents in dry electrophotographic toners by incorporating a compatibilizer (as mentioned above) which prevents the low surface free energy molecules from migrating to the toner surface and thus causing phase separation from the toner resin. The present invention is also successful in compatibilizing toner resins with a variety of other polymeric components of toner compositions, including colorants, wax release agents and charge control agents.

DISCLOSURE OF THE INVENTION

The main aspect of the present invention is the reactive compatibilization of toner resins with other polymeric components of the toner composition.

Other aspects of this invention will appear from the following description and appended claims, reference being made to the accompanying drawing forming a part of this specification wherein like reference characters designate corresponding parts.

In accordance with the present invention, various aspects and advantages are achieved by the employment of a reactive compatibilizer in toner compositions to compatibilize the toner resin with other polymeric components such as release agents, colorants or charge control additives. Broadly, the improved toners of the invention comprise a primary resin (i.e., toner resin) and at least one additional polymeric component, plus effective amounts of a functional secondary resin and a functional polymer reactive therewith to form a stable reaction product having monomer components compatible with at least one monomer component of the primary resin and of at least one of the additional polymeric components), the reaction product being present in an amount effective to compatibilize the primary resin and the additional polymeric component(s). For instance, the additional components compatibilized with the toner resin can be additional modifying resins, release agents such as silicone polymers or waxes, and/or charge control additives such as carboxylated (sulfonated) polystyrenes and calix(n) arene compounds. The additional polymeric components(s) to be compatibilized can also include colorants such as organic polymeric dyes, polymer-grafted carbon black and the like.

In preferred embodiments, the toner compositions comprise the primary resin, colorant and a first silicone polymer as release agent, plus effective amounts of a functional secondary resin and a functional silicone polymer reactive therewith to form a stable reaction product effective as a compatibilizer, this reaction product being present in the finished toner composition. For instance, in the examples below the additives used were a styrene-maleic anhydride copolymer and an amino-functional silicone oil. These materials reacted to form a styrene-silicone oil copolymer amic acid, represented generically by formula III of the sole Figure. Such stable reaction products can be produced by a number of combinations of copolymers based upon aromatic vinyl monomers and dibasic acid anhydride monomers reacted with a functional silicone polymer. A novel family of such aryl-silicone copolymer amic acids are claimed herein.

A further embodiment of the invention includes processes of preparing the improved toner compositions of the invention, comprising steps of:

a) combining materials comprising a primary resin and a first silicone polymer or other release agent, plus effective amounts of a functional secondary resin and a functional silicone polymer reactive therewith to form a stable reaction product effective as a compatibilizer, b) extruding the ingredients under conditions effective to form the reaction product of the secondary resin and the functional silicone polymer, and c) grinding the extruded and hardened product.

BRIEF DESCRIPTION OF THE DRAWING

The sole FIGURE illustrates the reaction of an amino-functional dialkyl siloxane polymer with a copolymer based upon aromatic vinyl monomers and dibasic acid anhydride monomers to form a novel aryl-silicone copolymer amic acid.

Before explaining the disclosed embodiments of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF PREFERRED EMBODIMENTS

Reactive Compatibilization

Figure 1:
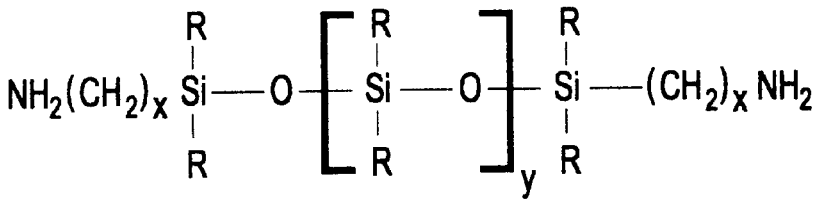
Figure 1:
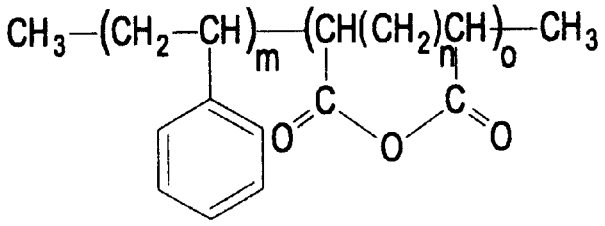
Figure 1:
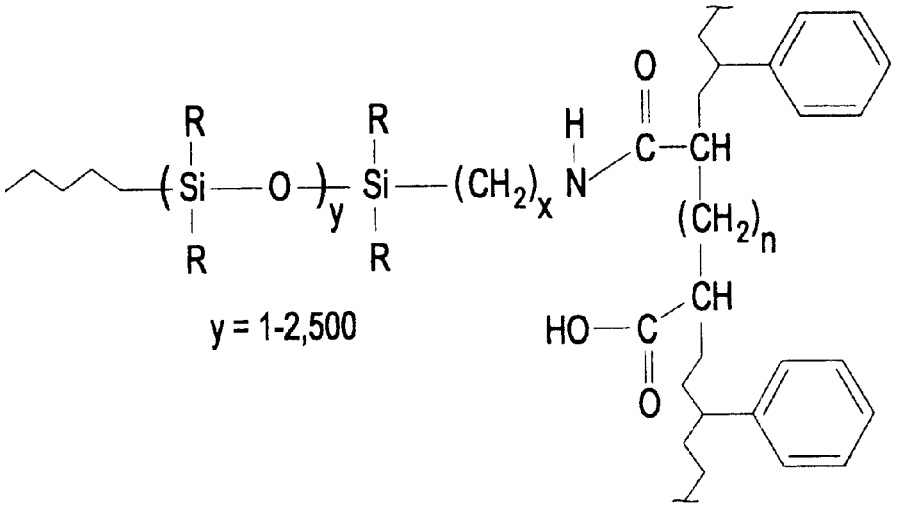

The successful approach of the present invention used to decrease or eliminate the migration of release agent molecules such as siloxane polymers or waxes to the toner particle surface during storage and also to reduce the amount of phase separation from the toner resin employs a novel concept of "reactive compatibilization". The subject of stabilizing polymer blends by preventing the thermodynamically-favored process of phase separation from occurring is called compatibilization. Compatibility is frequently defined as "miscibility on a molecular scale," and compatible blends may be defined as "polymer mixtures which do not exhibit gross symptoms of phase separation." However, Applicants presently adopt the convention of "technological compatibility" of Bonner and Hope, supra, wherein blends are considered as compatible when they possess a desirable set of properties, preferably with commercial value.

The most common method used to compatibilize two polymers, and thus prevent one from phase separation from the other, is to add a block copolymer (A–B). Usually in this type of compatibilization, one block, A, is chemically similar to one of the polymer components of the blend and the other block, B, is chemically similar to the other blend component. This method is usually extremely successful in stabilizing the polymer blend. Nevertheless, this method is rarely used in commercial applications because of the high expense usually involved in synthesizing the block copolymer.

A more practical way to compatibilize two polymers, in accordance with the present invention, is to add two reactive components to the polymer processing equipment (e.g., extruder) and have them react together during the melt mixing of the other components. In this case, no additional time needs to be spent on the synthesis of the compatibilizer, yet a successful copolymer can also be obtained. Specifically, reactive compatibilization in the terms of this invention preferably involves the formation of a block or graft copolymer via a coupling reaction between the reactive functional groups of the two additives. Typically, this method of compatibilization is not as successful as the one described above with prepared copolymers, because of the lack of a long residence time in the processing equipment necessary for the reaction to attain completion. It is thus very unlikely that the yield of copolymer from the processing of the two reactive additives in the mixture will be complete. Most likely, only some of the functional groups will react with each other to form such a copolymer, and side reactions may occur to destroy the linear structure of the block copolymer. Since such side reactions are functions of mechanochemical reactions, they may be minimized by reducing shear in the mixing process.

The "reactive compatibilization" approach has been developed as a way of obtaining a successful compatibilizer using commercially available materials. The concept of the invention is the addition of two functional polymeric materials to the existing toner formulation during melt mixing, one similar to the release agent such as silicone polymer or other polymeric component and one similar to the toner resin. Both additives must have functional reactive groups (in either terminal or side chain positions) so that during the melt mixing of the toner composition, the two reactive components couple to form the stable compatibilizer copolymer.

For instance, in examples below, the two functional materials added to the toner formulation (which already contained a poly(dialkylsiloxane) oil) were a styrene/maleic anhydride copolymer and a diamine-terminated poly (dimethylsiloxane) polymer. The reaction that took place was between the amino end groups and the anhydride side groups. During the extrusion and melt mixing of the toner materials, these functional groups reacted to form a fairly stable amic acid bond and thus, a polysiloxane/toner resin compatibilizer. Fourier Transform Infrared Spectroscopy can be used to examine the extent of the reaction between the anhydride and the amine functional groups. Typically, the level of residual amine or anhydride groups is measured to determine the extent of reaction.

Presumably, if the reaction went to completion, resulting in 100 percent yield, no residual amine groups would remain in the toner composition after extrusion. Experimentally, this was not found to be the case, since not all of the available functional groups react with each other. However, sufficient compatibilizer forms so that the undesirable print quality defects and toner physical properties commonly associated with the migration of silicone polymer molecules during storage or over the lifetime of the toner cartridge can be eliminated.

Toner Components

The toners of the present invention contain a primary or binder resin, known as a toner resin, such as a thermoplastic resin, a colorant such as a dye or pigment, and further, a charge control agent, releasing agent(s), optionally magnetic powder, and other additives as needed. These components will be separately described.

Any suitable binder resin can be used as the toner resin, including polyesters; homopolymers of styrene and substitution products thereof, such as polystyrene, poly-p-chlorostyrene, and polyvinyl toluene; styrene-type copolymers, such as styrene-p-chlorostyrene copolymer, styrene-vinyltoluene copolymer, styrene-vinylnaphthalene copolymer, styrene methyl-acrylate copolymer, styrene-ethyl-acrylate copolymer, styrene-butyl-acrylate copolymer, styrene-acrylate-2-ethyl-hexyl copolymer, styrene-octyl-acrylate copolymer, styrene-methyl-methacrylate copolymer, styrene-ethyl-methacrylate copolymer, styrene-butyl-methacrylate copolymer, styrene α-methyl-chloromethacrylate copolymer, styrene-acrylonitrile copolymer, styrene-vinyl-methyl-ether copolymer, styrene-vinyl-methyl-ketone copolymer, styrene-butadiene copolymer, styrene-isoprene copolymer, styrene-acrylonitrile-indene copolymer, styrene-maleic-acid copolymer, and styrene-maleate copolymer; polymethyl methacrylate; polybutyl methacrylate; polyvinyl chloride, polyvinyl acetate; polyethylene, polypropylene; polyurethanes; polyamides; epoxy resins; polyvinyl butyral; polyacrylic resins; rosin; denatured rosin; terpene resins; phenol resins; aliphatic or alicyclic hydrocarbon resins; aromatic-type petroleum resins; chlorinated paraffin; and paraffin wax. These may be used either singly or as mixtures. Polyesters are not preferred, because it is difficult to place reactive functional groups on a polyester resin backbone and because polyester resins are more reactive than polarylene resins such as polystyrene, increasing the tendency to obtain random copolymers rather than block or graft copolymers.

The colorant used in the present invention may be any well known colorant. More specifically, examples of the colorant include: dyes and pigments, such as carbon black, iron black, graphite, nigrosine, metallic complex of monoazo dye, ultramarine, copper phthalocyanine, methylene blue, chrome yellow, quinoline yellow, hanza yellow, benzene yellow, Du Pont Oil Red, and various types of quinacridone lake pigments. Polymeric colorants can be compatibilized by the present invention. Suitable polymeric colorants include the polymeric dyes presented by Kolb et al. in "In Situ Generation of Polymeric Dyes by Thermal Activation" at the 1994 annual conference of the Society for Imaging Science and Technology (May, 1994 Rochester, N.Y.), which paper is incorporated herein by reference. Other suitable polymeric colorants are the polymer grafted carbon blacks including hydrophobic styrene acrylic copolymers which are commercially available from RIT-CHEM CO., Inc. of Pleasantville, N.Y.

When the colorant is contained in a non-magnetic toner, it is desirable for its amount to be approximately 1 to 30 wt percent with respect to 100 wt percent of the non-magnetic toner. When the colorant is contained in magnetic toners, it is desirable for its amount to be approximately to 60 wt percent with respect to 100 wt percent of the magnetic toner.

The toner compositions can contain charge enhancing additives, for example, in an amount of from about 0.1 to 10 percent by weight including alkyl pyridinium halides, distearyl dimethyl ammonium methyl sulfate, metal salicylates and the like.

Examples of charge enhancing additives, usually present in an amount of from about 0.1 to about 10, and preferably 1–5 weight percent, include alkyl pyridinium halides, especially cetyl pyridinium chloride, reference U.S. Pat. No. 4,298,672, the disclosure of which is totally incorporated herein by reference; organic sulfates and sulfonates, reference U.S. Pat. No. 4,338,390, the disclosure of which is totally incorporated herein by reference; distearyl dimethyl ammonium methyl sulfate and similar additives, reference U.S. Pat. No. 4,560,635, the disclosure of which is totally incorporated herein by reference; and the like. Other charge control agents include the sulfonated copolymers disclosed in U.S. Pat. No. 4,883,735; the sulfonated styrene-acrylate ester copolymers disclosed in U.S. Pat. No. 5,073,469 and the calix(n)arene compounds disclosed in U.S. Pat. No. 5,318,883, all of which are incorporated herein by reference. Also useful are negative charge control agents such as the organic metal complexes (e.g. metal complexes of alkyl-substituted salicylic acid) disclosed in U.S. Pat. Nos. 5,437,949 and 5,256,512, both of which are incorporated herein by reference. Polymeric charge control agents can be compatibilized with the toner resin in the same manner as other polymeric components of the toner compositions.

The toner composition may also include, preferably as surface additives in an amount, for example, of from about 0.05 to about 3 percent by weight, of colloidal silicas, metal salts and metal salts of fatty acids such as zinc stearate, reference U.S. Pat. Nos. 3,590,000; 3,720,617; and 3,900,588, the disclosures of which are totally incorporated herein by reference.

The toner of the present invention can be used as a one-component type developer, or, as needed, mixed with carrier particles, such as iron powder, glass beads, nickel powder or ferrite powder, so as to be used as a two-component type developer.

Further, when the toner is used as a one-component type magnetic developer, a ferromagnetic element, or an alloy or compound which contains such ferromagnetic elements, is used as the magnetic powder. Specific examples of the magnetic powder include iron oxides, such as magnetite, hematite or ferrite, or alloys or compounds containing these iron oxides and cobalt, nickel or manganese, and other well-known ferromagnetic alloys which can be used as magnetic powder.

Waxes can be added as needed as supplemental releasing agents for fixation or for preventing offset, and can be compatibilized by the present invention. In the present invention, various well-known waxes can be employed, including polyolefin waxes such as polyethylene wax and polypropylene wax, or silicone wax, as well as natural waxes including carnauba and beeswax, in accordance with the requisite properties.

Surface additive compounds such as colloidal silicas, chemically modified silicas, metal salts of fatty acids, particulate polymers, various metal oxides and the like may be employed.

The present invention applies to a wide variety of toners, which can include the following proportions of principal ingredients and additives:

| Ingredient | minimum | maximum | of weight percent |
|---|---|---|---|
| Toner resin | 40 | 97 | of weight percent |
| Colorant | 1 | 60 | of weight percent |
| Charge control additive | 0.5 | 10 | of weight percent |
| Wax | 0.5 | 10 | of weight percent |
| Siloxane polymers | 0 | 2 | of weight percent |
| Other additives | 0 | 4 | of weight percent |

Formation of Compatibilizer

As described above, two additives are incorporated in the toner and the mixture is extruded to form a stable reaction product which acts as a reactive compatibilizer.

The object is to compatibilize polymeric components such as release agents, colorants, charge control agents or the like with the toner resin. This reaction is illustrated by the sole FIGURE, in which formula I represents an aminoterminated dialkyl siloxane polymer. In formula I, R represents a lower alkyl substituent having from to 1 about 10 carbon atoms, preferably methyl or ethyl. These groups can be the same or different. The number of methylene groups x can range from 1 to about 20, and y can range from about 1 to about 2500, representing the number of repeating siloxane groups per molecule. The molecular weight can range from about 150 to about 200,000, preferably from 300 to 20,000 g/mol. Formula II represents a copolymer of a vinyl aromatic monomer such as polystyrene, with the benzene ring representing an aryl group such as phenyl or substituted versions thereof, with m ranging from about 1 to about 5000. The other component of the copolymer is a dibasic acid anhydride monomer, where the number of methylene groups n ranges from 0 to about 6 and o ranges from 1 to about 200, preferably from about 5 to about 50. Compounds represents by formulas I and II react to form a stable reaction product represented by formula III, termed an aryl-silicone copolymer amic acid. In formula III, R again represents lower alkyl and the figures x and y can have the values specified for Formula I.

The two additives are incorporated in the toner in proportions which will produce the reactive compatibilizer. (under the conditions of melt mixing) in amounts effective to compatibilize the additional polymeric components) with the primary resin, preferably such as to attain technological compatibility. Preferably the resulting amount will be sufficient to prevent undesirable effects such as black-on-white defects. The amounts of the additives will vary according to their chemical identities and those of the primary resin and additional polymeric components) and their proportions, plus reaction conditions. However, the proportions generally will range from about 0.1 to about 5.0, preferably from about 0.25 to about 2.0 and most preferably from about 0.25 to about 1.0 weight percent of the complete toner.

Functional Silicone Polymers

Formula I represents generically the amino-terminated version of the dialkyl polysiloxane polymers which can be used in the invention. These polymers can be solid resins or oils, and are combined with the other reactants and toner components in melt mixing. The terminal amino groups are merely representative of a family of suitable functional groups reactive with corresponding groups on the copolymer used as the second additive. Such functional groups can have terminal or side chain positions and include hydroxyl groups, primary amine, dialkylamino terminal groups, carboxyl-terminated carbinol groups, epoxy groups, (meth) acrylate groups, halo groups such as chloro, alkoxy groups such as methoxy, hydride groups, haloalkyl groups such as chloropropyl, mercapto groups, acid anhydride terminal groups such as succinic anhydride, carboxyalkyl groups and vinyl groups. Table I lists a series of commercially available organofunctional silicone fluids.

TABLE I

Organofunctional Silicone Fluids
Chemical Structures and Typical Properties
$R—SiMe_2O(Me_2SiO)_nSiMe_2$-R

| Commercial Designator | Functionality R | Chain Length n | Mn |
|---|---|---|---|
| CT101 | Silanol —OH | | |
| IM 11 | Carbinol | 10 | 1000 |
| IM 15 | $—(CH_2)_3OH$ | 50 | 4000 |
| IM22 | $—(CH_2)_3—(OCH_2CH_2)_{10}OH$ | 15 | 1800 |
| SLM 55019/7 | Amino | 10 | 1050 |
| IM 47 | $—(CH_2)NHCH_2CH_2CH_2NH_2$ | 70 | 5400 |
| SLM 440124/4 | Carboxyl | 10 | 1250 |
| SLM 441024/3 | $—(CH_2)_3O_3CCH_2CH_3CO_2H$ | 50 | 4000 |
| SLM 50240/4 | Anhydride | 25 | 2000 |
| IM86 | 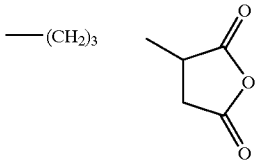 | 60 | 4000 |
| SLM 50238 | Epoxy 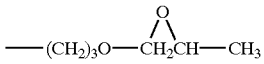 | 10 | 1100 |
| SLM 50250/6 | | 50 | 4000 |
| IM 51 | Acylate $—(CH_2)_3O_3CCH{=}CH_2$ | 10 | 1100 |

Functional Waxes

When the additional polymeric components to be compatibilized include waxes, one of the additives used to form the reactive compatibilizer can be a functional wax. Such a functional wax can be at least similar to the wax used as a release agent (e.g., polyethylene, polypropylene, or silicone waxes, carnauba wax and beeswax) but have functional groups the same as the other (copolymer) additives. For example, a polystyrene or other polyarylene material can be functionalized with oxazoline or other groups, which can react with functional groups on the wax such as carbonyl, anhydride, epoxy and amino. Polyolefin waxes and natural waxes can be functionalized with reactive groups such as hydroxyl, carbonyl, phenolic, amino, mercapto and halo. The natural waxes include categories of animal (beeswax, lanolin), vegetable (carnauba, sugar cane) and mineral (paraffins). Commercially available functionalized waxes and/or resins include the following:

EPOLENE E-43P: Polypropylene-graft-maleic anhydride

PRIMACOR 3440: Polyethylene-graft-acrylic acid

PETROLITE X-8039: alpha-olefin-graft-maleic anhydride

UNICID 700: Polyethylene-COOH (end group)

UNILIN 700 Polyethylene-OH (end group)

JEFFAMINE series Polyethylene-graft amine (side group)

Functional Copolymers

Formula II in the FIGURE represents a copolymer of a vinyl aromatic monomer, where the benzene ring represents phenyl, phenyl substituted with lower alkyl, halo, hetroatomic functional groups, and polycyclic aromatics. The other monomer is a dibasic acid anhydride which can be selected from diacids including terephthalic acid, p-carboxyphenyl acetic acid, diphenyl-p,p' dicarboxylic acid, diphenyl-4,4'-diacetic acid, diphenylmethane-p,p-dicarboxylic acid, benzophenone-4,4'-dicarboxylic acid, naphthalene-2,7-dicarboxylic acid, naphthalene-2,6-dicarboxylic acid, p-carboxyphenyloxy acetic acid, 1,2-diphenoxyethane-p,p'-dicarboxylic acid, 1,3-diphenoxypropane-p,p'-dicarboxylic acid, 1,4-diphenoxybutane-p,p'-dicarboxylic acid, p(p-carboxyphenoxy) benzoic acid, p(p-carboxybenzoyloxy) benzoic acid, adipic acid, sebacic acid, maleic acid, fumaric acid, phthalic acid, isophtalic acid, azelaic acid and succinic acid. Presently a styrene-maleic anhydride copolymer is preferred for combining and reaction with an amino terminated dimethylsiloxane polymer.

Combinations of Functional Groups

As discussed above, in a preferred embodiment the amino groups of the siloxane polymer react with the anhydride side groups of the functional copolymer (the secondary resin). Other suitable combinations of functional groups which can be employed on these additive components to react under melt mixing conditions to form stable compatibilizer products include:

Primary amine+cyclic anhydride form an amic acid, or at higher temperatures, an imide;

Primary amine+oxazoline form an amino-ethyl-amide;

Primary amine+carbodimide form a guanidine;

Primary amine+isocyanate form a urea;

Carboxylic acid+epoxide form a hydroxy-ester;

Carboxylic acid+alcohol form an ester;

Carboxylic acid+oxazoline form an ester/amide;

Carboxylic acid+carbodimide form an amide;

Carboxylic acid+isocyanate form an amide; and

Alcohol+isocyanate form a urethane.

These reactions and products are shown below in Table II.

TABLE II

Some Reactions Used in the In-Situ Formation of Block Polymer Compatibilizers*

| REACTANTS | LINKAGE TYPES |
|---|---|
| cyclic anhydride + primary amine → | imide + $H_2O$ |
| epoxide + primary amine → | secondary amine |
| epoxide + carboxylic acid → | hydroxy-ether |
| oxazoline + primary amine → | aminoethyl-amide |
| oxazoline + carboxylic acid → | ester/amide |
| carbodimide + primary amine → | guanidine |

TABLE II-continued

Some Reactions Used in the In-Situ Formation of Block Polymer Compatibilizers*

| REACTANTS | | | LINKAGE TYPES |
|---|---|---|---|
| carbodimide | + | carboxylic acid | amide (+ R—N═C═O) |
| isocyanate | + | primary amine | urea |
| isocyanate | + | carboxylic acid | amide + $CO_2$ |
| isocyanate | + | alcohol | urethane |

From N. G. Gaylord, "Reactive Extrusion"; Ed. M. Xanthos, Hanser, New York 1992

*Examples of end-linking reactions are shown here however, reaction of functional groups can take place at points along the chains Preparation process The process of preparing the improved toners of the invention includes steps of combining materials comprising a primary resin, colorant and at least one additional polymeric material such as a silicone polymer plus effective amounts of a functional secondary resin and a functional polymeric material, mixing these ingredients under conditions of temperature and pressure to form a reaction product of the secondary resin and functional polymeric material, then grinding the hardened product. Any suitable mechanical means of melt mixing can be used, including extrusion (using compounding co-rotating, intermeshing twin-screw or single screw extruders), Brabender batch mixers, Banbury batch mixers or Rheomixers (continuous or batch). The mixing process must form sufficient reaction product to compatibilize the primary resin with the additional polymeric materials.

Preferably, the melt-mixed product is extruded and allowed to harden before being ground into fine particles, which are then classified to optimize the particle size distribution.

The invention will be further illustrated by the following non-limiting examples.

EXAMPLES

Toners Containing Silicone Polymers

Toner compositions containing various proportions of silicone polymers as release agents were prepared, both with and without compatibilizing additives of the invention, tested.

Materials

The polymer used for toner preparations was a random styrene/acrylic copolymer, crosslinked with divinylbenzene, obtained from a commercial source. Whenever possible, samples of SMA-8097 and GP-145 were protected from atmospheric moisture. Comparative toner formulations are described in Table 1. Trademarked products used are identified or described in the GLOSSARY below.

Processing

All raw materials were used in a granulated or powder form, except for Siloxane polymer, styrene-maleic anhydride copolymer and functional polysiloxane, which were added as received. Blends of the appropriate compositions were physically blended (Henschel blender) until homogeneous and subsequently extruded.

Extrusion was accomplished in a Werner Pfleiderer continuous twin screw extruder (Model ZSK 30) maintained within a temperature range of 135–210 degrees C. and at appropriate torque. The molten extrudate was cooled by passage through a chilled roller assembly and the resulting ribbons crushed.

Coarse grinding in a mill reduced the particle size to 3–5 mm. Further particle size reduction was carried out in an Alpine mill. Classification was then accomplished in an elbow jet classifier to control the particle size distribution to a median volume diameter of 11 microns. Surface borne extraparticulate additives were added to the classified powders using a Henschel blender.

TABLE 1

| Bulk: | Example A (Control) | Example 1 |
|---|---|---|
| Resin binder | 90.5% | 90.0% |
| carbon black | 5.0% | 5.0% |
| Metal salicylate CCA | 2.5% | 2.5% |
| Polyethylene Wax | 1.0% | 1.0% |
| Other additives | 1.0% | 1.0% |
| Siloxane polymer | 0.5% | 0.25% |
| Styrene-maleic anhydride copolymer | 0.0% | 0.5% |
| Amino-siloxane polymer | 0.0% | 0.25% |

All percentages are weight percent.

Characterization

The powder flow test is a direct determination of the amount of energy necessary to pull apart aggregates of cohesive particles in a specified time. The powder flow of toner is an important aspect to consider in designing a toner because of the required performance in the electrophotographic process.

The powder flow test using the PT-E Micron Powder System instrument allows for the evaluation of the flowability of the toner by measuring the amount of toner passing through a sieve during a preset time relative to the initial loading of toner on the sieve. The sieve is supported on a cantilever and is vibrated at a frequency of 60 Hz. The intensity (amplitude) of the vibration is controlled using a voltage adjustment. Generally, a free flowing material will tend to flow steadily and consistently. Conversely, a non free flowing material will tend to flow as agglomerated particles.

An issue that is associated with PT-E powder characteristics tester is that the mechanism used to vibrate the sample on the screen is an uncontrolled electromechanical device. In short, an electromagnet operates on a controlled half cycle and is allowed to return to an equilibrium position by "free fall". Consequently, there exists day to day as well as instrument to instrument variability, variability of the measurement is compensated for in part, by determining the powder flow of a control material. Depending on the extent that the powder flow is out of control using statistical process control, the voltage on the PT-E instrument can be changed to bring the reference material back into control.

The procedure for finding the apparent powder flow involves determining the retention of material on various micron screens depending on the material used for the test. Approximately six grams of tapped toner is placed on top of the screen. The screen is vibrated for a defined number of seconds which is typically 60 to 90 seconds depending on the toner to be investigated. The amount of material left on the pan is then weighed and the powder flow calculated. The formula is:

$$\text{Powder flow} = \left[\frac{\text{Weight of toner in pan}}{\text{toner weight}}\right] \times 100$$

The cohesiveness of the toner is also an important characteristic. The cohesiveness affects powder flow, the lower cohesion values being associated with higher powder flows.

To measure the cohesiveness a measured amount of toner is placed on a screen. Three screens of reducing size are placed in series so that the powder goes through increasingly smaller screens.

The starting amount of toner and the clean weight of each of the screens are obtained. The screens are then placed in the PT-N Micron Powder System instrument. In these tests a 150 $\mu$ screen, a 75 $\mu$ screen and a 45 $\mu$ screen were used. The largest screen is the top screen, with the other two placed underneath in order of decreasing size.

The screens are then vibrated for 90 seconds with a 1 mm vibration amplitude. The screens are then removed and re-weighed. The formula for cohesion is:

$$\left[\frac{(Wt \text{ on Top Screen} + 3/5Wt \text{ on Middle screen} + 1/5Wt \text{ on Bottom Screen})}{(\text{Initial } Wt \text{ of Toner})}\right] \times 100$$

The powder flow characteristics of these toners were determined (Table 2) using the standard Hosokawa Micron devices for cohesion (Model PT-N) and powder flow (Model PT-E).

TABLE 2

| | Example A | Example 1 |
|---|---|---|
| Cohesion | 31.0% | 23.0% |
| Powder flow (355u) | 75.4% | 79.8% |

It can be seen that the additives used in Example 1 improved toner powder flow and cohesion (i.e., reducing cohesion) over the control, Example A. Further examples of toner compositions with various proportions of styrene/maleic anhydride copolymers and an amino functional silicone oil were prepared as described above and tested for powder flow and cartridge end-of-life background reflectance. The test results are shown in Tables 3 and 4.

TABLE 3

Powder Flow Data for Unfinished Toners (355 $\mu$m Screen)

| Example | Styrene/Maleic Anhydride wt % | Functionalized oil wt % | Powder Flow % | Cohesion % |
|---|---|---|---|---|
| 2 | 0.50% | 0.25% | 75.5 | 28 |
| 3 | 0.30% | 0.15% | 66.2 | 35 |
| 4 | 0.75% | 0.38% | 62.5 | 36 |
| 5 | 0.45% | 0.23% | 66.7 | 33 |
| B (control) | 0.0% | 0.0% | 59.3 | 39 |
| 6 | 1.05% | 0.47% | 71.8 | 29 |

TABLE 4

Cartridge* End-of-Life (EOL) Background Reflectance (Fog)

| Example | Styrene/Maleic Anhydride wt % | Functionalized oil wt % | EOL Bkgd. Reflectance |
|---|---|---|---|
| 2 | 0.50% | 0.25% | 0.36 |
| 3 | 0.30% | 0.15% | 0.48 |
| 4 | 0.75% | 0.38% | 0.49 |
| B (control) | 0.0% | 0.0% | 1.09 |
| 6 | 1.05 | 0.47% | .36 |

*Functional evaluation requires finished toner

The powder flow results for the unfinished toners are shown above in Table 3. Example B is the control sample in this research and contains no compatibilizer at all, only the siloxane polymer and the rest of the toner additives. On the other hand, the rest of the toners contain various amounts of the two functionalized resins. These amounts are listed in columns 2 and 3 of each table. It can be seen that Examples 2 and 6 have the highest powder flow and lowest cohesion values of the toners tested. Cohesion and powder flow are inversely related to one another. A higher powder flow or lower cohesion value is most desirable for this application. From the tables it can be observed that the "in-situ compatibilizer" is successful in increasing the powder flow of these toners by preventing the siloxane polymer from migrating to the toner surface during storage, a phenomenon known to cause a dramatic reduction in powder flow over time.

Table 4 contains the end of cartridge life background reflectance data for the finished toners of Table 3. Again Example B is the control toner and did not contain the two reactive ingredients used to make the in-situ compatibilizer. As expected, the EOL background reflectance values are much lower (better) for the compatibilized toners in the numbered examples. By compatibilizing the siloxane polymer with the styrene/acrylic toner resins, good dispersion of silicones can be obtained, resulting in good toner composition uniformity. Consequently, the background reflectance at EOL is reduced in comparison with the toners that do not contain an oil/resin compatibilizer.

Toners Containing Wax Release Agents

Toner compositions containing polyethylene or polypropylene waxes as release agents were prepared as follows and tested for wax domain size. Using batch processing, resin, wax, charge control agent and other solid ingredients were added. Each batch added to a FM Henschel dry bender and mixed.

The mixture was then extruded as noted previously.

The cooled extrudate was milled and classified as above to the 11 micron volume median size.

The milled powder was blended with additives in a Henschel (FM10) blender.

The samples and their contents are listed below:

Example C (Control #1 w/Polyethylene)

| Material | Parts | Weight (g) |
|---|---|---|
| Styrene acylic resin | 90.5 | 3697.7 |
| Other additives | 1.0 | 40.9 |
| Polyethylene Wax | 1.0 | 40.9 |
| Metal Salicylate CCA | 2.5 | 102.2 |
| Carbon black | 5.0 | 204.3 |
| | 100.0 | 4086.0~9pounds |
| Siloxane Polymer | 0.47 | 19.2 |
| | 100.43 | 4105.2 |

Example D (Control #2 w/Polyethylene.

| Material | Parts | Weight (g) |
|---|---|---|
| Styrene acylic resin | 89.0 | 3636.4 |
| Other additives | 1.0 | 40.9 |
| Polyethylene Wax | 2.5 | 102.2 |
| Metal Salicylate CCA | 2.5 | 102.2 |
| Carbon black | 5.0 | 204.3 |
| | 100.0 | 4086.0~9pounds |
| Siloxane Polymer | 0.47 | 19.2 |
| | 100.43 | 4105.2 |

Example 7

| Material | Parts | Weight (g) |
|---|---|---|
| Styrene acylic resin | 88.0 | 3595.5 |
| Other additives | 1.0 | 40.9 |
| Functionalized polystyrene | 0.5 | 20.5 |
| Metal Salicylate CCA | 2.5 | 102.2 |
| Carbon black | 5.0 | 204.3 |
| Polyethylene-polyacrylate copolymer | 0.5 | 20.5 |
| | 100.0 | 4086.0~9pounds |
| Siloxane Polymer | | |
| | 100.43 | 4105.2 |

Example E (Control w/Polypropylene)

| Material | Parts | Weight (g) |
|---|---|---|
| Styrene acylic resin | 90.0 | 3677.3 |
| Other additives | 1.0 | 40.9 |
| Polypropylene wax | 1.5 | 61.3 |
| Metal Salicylate CCA | 2.5 | 102.2 |
| Carbon black | 5.0 | 204.3 |
| | 100.0 | 4086.0~9pounds |
| Siloxane Polymer | 0.47 | 19.2 |
| | 100.43 | 4105.2 |

Example F (Control w/Polypropylene)

| Material | Parts | Weight (g) |
|---|---|---|
| Styrene acylic resin | 88.5 | 3616.0 |
| Other additives | 1.0 | 40.9 |
| Polypropylene wax | 3.0 | 122.6 |
| Metal Salicylate CCA | 2.5 | 102.2 |
| Carbon black | 5.0 | 204.3 |
| | 100.0 | 4086.0~9pounds |
| Siloxane Polymer | 0.47 | 19.2 |
| | 100.43 | 4105.2 |

Example 8

| Material | Parts | Weight (g) |
|---|---|---|
| Styrene acylic resin | 88 | 3595.5 |
| Other additives | 1.0 | 40.9 |
| Polyethylene wax | 1.0 | 40.9 |
| Funtionalized polyethylene | 0.5 | 20.4 |
| Functionalized polystyrene | 0.5 | 20.5 |
| Metal Salicylate CCA | 2.5 | 102.2 |
| Carbon black | 5.0 | 204.3 |
| Siloxane Polymer | 0.47 | 19.2 |
| | 100.47 | 4105.2 |

Example 9

| Material | Parts | Weight (g) |
|---|---|---|
| Styrene acylic resin | 88.0 | 3595.5 |
| Other additives | 1.0 | 40.9 |
| Polyethylene wax | 1.0 | 40.9 |
| Alpha-olefin-graft-anhydride | 0.5 | 20.4 |
| Functionalized polystyrene | 0.5 | 20.5 |
| Metal Salicylate CCA | 2.5 | 102.2 |
| Carbon black | 5.0 | 204.3 |
| Siloxane Polymer | 0.47 | 19.2 |
| | 100.47 | 4105.2 |

Example 10

| Material | Parts | Weight (g) |
|---|---|---|
| Styrene acylic resin | 88.00 | 3595.5 |
| Other additives | 1.0 | 40.9 |
| Polyethylene wax | 1.0 | 40.9 |
| Polyethylene-acrylic acid | 0.5 | 20.4 |
| Functionalized polystyrene | 0.5 | 20.5 |
| Metal Salicylate CCA | 2.5 | 102.2 |
| Carbon black | 5.0 | 204.3 |
| Siloxane Polymer | 0.47 | 19.2 |
| | 100.47 | 4105.2 |

Example 11

| Material | Parts | Weight (g) |
|---|---|---|
| Styrene acylic resin | 87.5 | 3575.1 |
| Other additives | 1.0 | 40.9 |
| Polypropylene wax | 3.0 | 122.6 |
| Functionalized polyproplene | 0.5 | 20.4 |
| Functionalized polystyrene | 0.5 | 20.5 |
| Metal Salicylate CCA | 2.5 | 102.2 |
| Carbon black | 5.0 | 204.3 |
| | 100.0 | 4086.0~9pounds |
| Siloxane Polymer | 0.47 | 19.2 |
| | 100.43 | 4105.2 |

The toners of Examples C, D, E, F, and 7–11 were examined for largest wax domain size by scanning electron microscopy. These results are shown below in Table 5.

TABLE 5

| Example | Wax (%) | Modifier (%) | Largest wax domain found (u) |
|---|---|---|---|
| C | Polyethylene wax (1.0) | — | 1.9 |
| D | Polyethylene wax (2.5) | — | 6.2 |
| 7 | Polyethylene wax (2.5) | MODIPER A8100 (0.5)/ EPOCROSS RPS-1005 (0.5) | 4.2 |

TABLE 5-continued

| Example | Wax (%) | Modifier (%) | Largest wax domain found (u) |
|---|---|---|---|
| 8 | Polyethylene wax (2.5) | UNICID 700 (0.5)/ EPOCROSS RPS-1005 (0.5) | 3.6 |
| 9 | Polyethylene wax (2.5) | PETROLITE X-8039 (0.5)/ EPOCROSS RPS-1005 (0.5) | 3.7 |
| 10 | Polyethylene wax (2.5) | PRIMACOR 3440 (0.5) EPOCROSS RPS-1005 (0.5) | 5.1 |
| E | Polyethylene wax (1.5) | — | 3.7 |
| F | Polyethylene wax (3.0) | — | 4.7 |
| 11 | Polyethylene wax (3.0) | EPOLENE E-43P (0.5)/ EPOCROSS RPS-1005 (0.5) | 3.6 |

Increasing polyethylene wax loading to 2.5 percent caused a significant increase in the largest wax domains found. The additions of various compatibilizers does reduce wax domain size, some better than others. Increasing the polypropylene wax level also increases wax domain size, but not as much. The addition of compatibilizers to polypropylene wax had less effect in reducing wax domain size.

Conclusions

From the above disclosure and examples it should be apparent that toners comprising blends of two or more polymers (i.e., the toner resin and at least one additional polymeric component) can be compatibilized through reactive compatibilization by melt-mixing these components with two functional polymeric materials which react to form a stable compatibilizer containing monomer components at least similar to those contained in the polymers of the original blend. Toner composition uniformity is improved through the use of such reactive compatibilization. Such improvement is advantageous because it enables the reduction of toner particle size (if needed) without reducing print quality due to toner uniformity related effects. Even though the residence time in a twin-screw extruder is short, reactions between functionalized polymers can take place to form novel copolymers that act as compatibilizers between the toner resin and polymeric toner additives such as waxes and charge control agents.

Although the present invention has been described with reference to preferred embodiments, numerous modifications and variations can be made and still the results will come within the scope of the invention. No limitation with respect to the specific embodiments disclosed herein is intended or should be inferred.

This invention is operative with virtually any toner or developer, dry or liquid, having an organic binder or toner resin or the equivalent. Other variations in accordance with this invention will be apparent or may be developed employing this invention.

Accordingly, patent protection commensurate with this invention is sought as provided by law, with particular reference to the following claims.

GLOSSARY

SMA 8097 styrene-maleic anhydride random copolymer gp-145 functionalized polydimethysiloxane (amino-terminated)

EPOCROSS RPS-1005 functionalized polystrene (oxazoline side groups)

EPOLENE E-43P functionalized polypropylene (maleic anhydride side groups)

X-8039 alpha olefin-graft maleic anhydride copolymer

UNICID 700 functionalized polyethylene (carboxylic acid terminated)

PRIMACOR 3440 polyethylene-acrylic acid copolymer

MODIPER A8100 polyethylene-ethyl acrylate-maleic anhydride-graft PS terpolymer

What is claimed is:

1. A method of making a toner composition comprising melt mixing a primary resin and at least one additional polymeric component, plus a functional secondary resin and a functional polymer reactive therewith to form a stable reaction product of said functional secondary resin and said functional polymer having one of said secondary resin and said functional polymer components being compatible with at least one monomer component of said primary resin and another of said secondary resin and said functional polymer components being compatible with at least one of said additional polymeric component, said reaction product of said secondary resin and said functional polymer being in amounts effective to compatibilize the primary resin and at least one of said additional polymeric component.

2. The method of claim 1, wherein said additional polymeric component comprises a silicone polymer.

3. The method of claim 2, wherein said functional polymer is a dialkyl polysiloxane with terminal functionality selected from the group consisting of amino, hydroxyl, carboxyl, carbinol, (meth)acrylate, halo alkoxy, hydride, haloalkyl, mercapto, acid anhydride, carboxyalkyl, and vinyl groups.

4. The method of claim 1, wherein said additional polymeric component comprises a wax.

5. The method of claim 1, wherein said additional polymeric component comprises a charge control additive.

6. The method of claim 1, wherein said additional polymeric component comprises a colorant.

7. The method of claim 1, wherein said secondary resin is a copolymer of an aromatic vinyl monomer and a dibasic acid anhydride.

8. The method of claim 1, wherein said secondary resin is a styrene-maleic anhydride copolymer and said functional polymer is a diamino-terminated poly(dialkylsiloxane).

9. The method of claim 1, wherein said primary resin is selected from the group consisting of homopolymers and copolymers of styrene and substitution products thereof, polyacrylic resins, polyvinyl butyral, polyurethanes, polyamides, and epoxy resins.

* * * * *